United States Patent [19]

Cagnazzi

[11] 4,344,535

[45] Aug. 17, 1982

[54] POCKET ACCESSORY FOR ORAL HYGIENE

[75] Inventor: Ernesto Cagnazzi, Monza, Italy

[73] Assignee: Meka S.N.C. di P. Merati & C., Monza, Italy

[21] Appl. No.: 160,878

[22] Filed: Jun. 19, 1980

[30] Foreign Application Priority Data

Jun. 20, 1979 [IT] Italy ..... 21901/79[U]

[51] Int. Cl.[3] ..... B65D 69/00; A44D 44/18; A63H 27/00; A46B 11/00

[52] U.S. Cl. ..... 206/581; 132/84 R; 206/229; 401/191

[58] Field of Search ..... 206/581, 229, 38, 15.2, 206/15.3; 132/84 R; 401/191

[56] References Cited

U.S. PATENT DOCUMENTS

| | | | |
|---|---|---|---|
| 2,247,003 | 6/1941 | Smith et al. | 132/84 B |
| 2,379,600 | 7/1945 | Smith et al. | 206/229 |
| 2,455,600 | 12/1948 | Molumby et al. | 206/229 |
| 2,599,019 | 6/1952 | Rupert | 132/84 R |
| 3,734,118 | 5/1973 | Howard | 132/84 R |

*Primary Examiner*—William T. Dixson, Jr.

*Attorney, Agent, or Firm*—Seidel, Gonda, Goldhammer & Panitch

[57] ABSTRACT

A pocket accessory for oral hygiene in which on a single support element 3 there are fixed a pocket toothbrush 1 and a pocket dentrifice container 2, the said support element 3, when the brush 1 and container 2 are introduced into a case 8 being adapted to constitute a closure element of the said case, and the said support element 3 when the brush 1 and the container 2 are in the withdrawn position being adapted to be inserted in forced manner into the open extremity of the case 8, the latter forming the handle of the accessory.

7 Claims, 6 Drawing Figures

Fig. 1
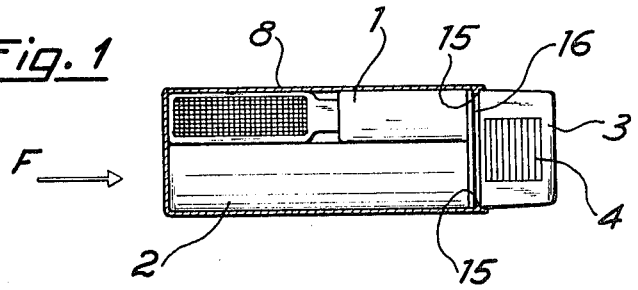
Fig. 2
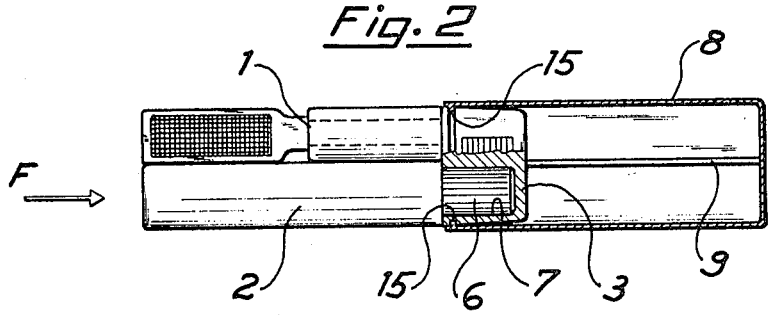
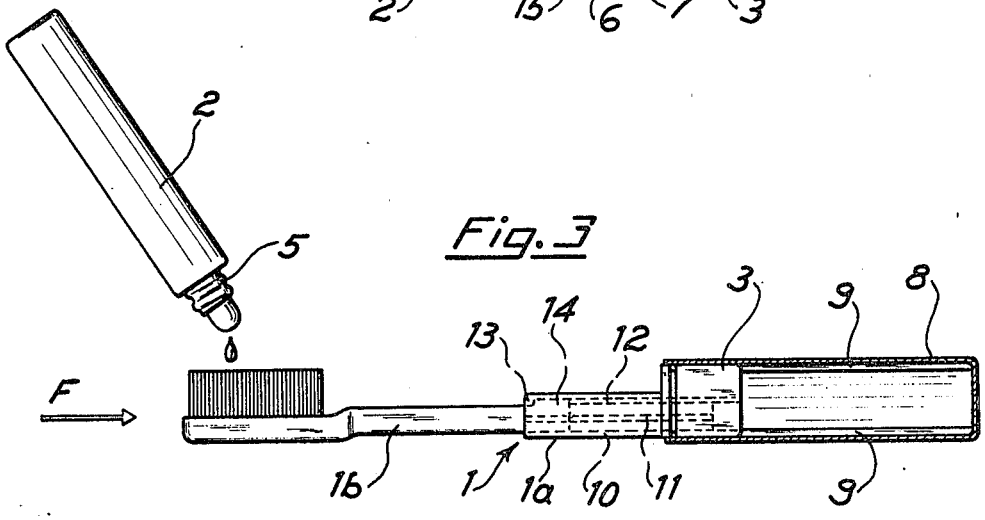
Fig. 3
Fig. 4
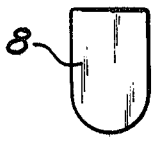
Fig. 5
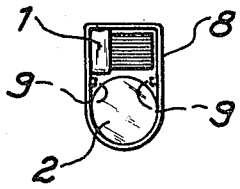
Fig. 6
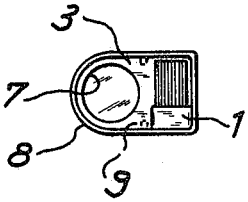

POCKET ACCESSORY FOR ORAL HYGIENE

The present invention relates to a pocket accessory for oral hygiene which comprises a tooth-brush and a dentrifice container in a case.

It is known that it is extremely important, for correct and complete oral hygiene, to be able to have available throughout the day the normal equipment constituted by the tooth-brush and the dentrifice container.

Various solutions have been proposed to resolve this problem, which however have turned out to be either incomplete or extremely complex.

In fact tooth-brushes have been produced with especially small dimensions so as to be pocketable, but such brushes required the use of a normal and bulky toothpaste tube.

Moreover, toothpaste tubes or liquid dentrifice containers have been produced which are adapted to be contained in a pocket, but such tubes or containers turned out to be particularly inconvenient in use in as much as the user had to carry a tooth-brush with him, separately from the said tubes or containers. This could be a normal tooth-brush or one of the above-mentioned pocket brushes. In every case the two objects were anyhow separated and this rendered their use inconvenient.

Furthermore tooth-brushes have been produced incorporating a liquid dentrifice supply reservoir, but such brushes were bulky by reason of the presence of the said reservoir.

A pocket accessory for oral hygiene is now proposed and satisfies the object of the present invention, in which both the tooth-brush and the dentrifice container are incorporated, both having particularly small dimensions and being adapted to be lodged in a case which is appropriate for carrying out the function of the handle of the accessory as well.

The accessory according to the present invention comprises fixed on a single support element a pocket tooth-brush and a pocket dentrifice container, the said support element, when the brush and container are introduced into a case being adapted to constitute a closure element of the said case, and the said support element when the brush and container are in the withdrawn position being adapted to be inserted in forced manner into the open extremity of the case, the element forming the handle of the accessory.

The body of the tooth-brush may be telescopic so as to possess its minimum dimension when it is not in use and its maximum dimension when it is in use.

The characteristics and advantages of the accessory according to the present invention will become apparent from the following detailed description of an embodiment of the invention non-limitatively described with reference to the accompanying drawings, in which:

FIG. 1 is a view representing the accessory in the closed position with the case in longitudinal section;

FIG. 2 is a view of the open accessory with the case in longitudinal section;

FIG. 3 is a view representing the accessory in its utilisation position, again with the case in longitudinal section; and FIGS. 4, 5 and 6 are views of the accessory in the direction of the arrows F respectively in FIG. 1, FIG. 2 and FIG. 3.

With reference to the drawing, the accessory comprises a tooth-brush 1 and a dentrifice container 2. The tooth-brush 1 and the dentrifice container 2 are fixed on a single support element 3. The support element 3 is constituted by a substantially parallelepipedic body, made for example of plastic material, which as appears especially from FIG. 1 is slightly constricted towards the opposite extremity to that where the brush 1 and the container 2 are fixed. The support element 3 has a milling 4 (only one of which is visible in FIG. 1) on its two major faces, to facilitate grasping by the user. The brush 1 and the container 2 are fixed detachably at one extremity to the support element 3.

In particular the extremity of the body of the brush 1 is inserted under pressure into a cavity (not shown) of the support element 3. The dentrifice container 2 possesses the partially threaded dispensing extremity 5 and a closure cap 6 fixed within a cavity 7 of the support element 3 is screwed on to it.

As may be noted from FIGS. 1 and 2, when the brush 1 and the dentrifice container 2 are fixed to the support element 3, they present the same height so as to be insertable into a containing case 8. The latter, as appears from FIG. 1, possesses a length slightly greater than that of the part of the brush 1 and of the container 2 protruding from the support element 3. This permits slightly forced insertion of the major base of the element 3 into the open extremity of the case 8 while teeth 15 are snapped into a groove 16 of the element 3 when element 3 is inserted into case 8. In this way in the closed position the support element 3 further forms a closure element of the case 8. Clearly, the major base of the element 3 will be slightly greater than the dimensions of the open extremity of the case 8, which will advantageously be made of a slightly elastic material.

As appears in particular from FIGS. 4, 5 and 6, the case 8 has a substantially parallelepipedic form one major side of which is substantially semi-circular so as to adapt itself to the cylindrical form of the dentrifice container 2, thus subsequently reducing the bulk of the accessory. Clearly the support element 3 will also have an analogous form, that is to say will be substantially semi-circular on one of its sides, as appears from FIGS. 5 and 6.

When the brush 1 and container 2 are withdrawn from the case 8, they are still fixed to the latter by means of the support element 3. The latter is inserted with slight forcing into the open extremity of the case 8 so that teeth 15 snap into groove 16, because of the above-mentioned form of the element 3 with variable width. The latter is arrested against two longitudinal internal ribs 9 of the case 8 so that the base of the element 3, from which the brush 1 and the container 2 protrude, is substantially flush with the open extremity of the case 8. The ribs 9 do not impede the introduction of the brush 1 and container 2, as appears from FIGS. 5 and 6 where they are provided in the zone included between these.

With reference now to FIG. 3, the manner of use of the accessory according to the present description is represented. The cap 6 us unscrewed from the (in this case liquid) dentrifice container 2 and dentrifice is poured on to the bristles of the brush 1, which has been brought into its position of maximum length, as it is of telescopic type.

The body of the brush 1 is in fact made in two parts 1*a*, 1*b* which are slidable in relation to one another. In particular the part 1*a*, fixed to the support element 3, has a longitudinal cavity 10 adapted to permit the insertion of the part 1*b* and is provided with two longitudinal grooves 11 and 12, of which the groove 11 extends throughout the length of the part 1*a* while the groove 12 extends partially over the length of the part 1*a*, in particular as far as the point indicated by 13 in FIG. 3.

In this way the part 1*b*, which possesses a stop protuberance 14 at its extremity, can be introduced into the part 1*a* through the groove 11 and then rotated until its protuberance 14 engages in the groove 12. The part 1*b* can then be unscrewed from the part 1*a* until the protuberance 14 is arrested at the end of the groove 12 at the point 13. The brush 1 is returned to the original position simply by inserting the part 1*b* into the part 1*a*.

The advantages deriving from the accessory according to the present invention include the accessory being a single case comprising both the brush and the dentrifice container, and the support element of these parts can operate both as closure element of the case and as element for connection with the case, which in this case also forms the handle of the accessory.

A further advantage consists in the lengthening ability of the brush 1, which can be at least practically the length of a normal tooth-brush.

It is apparent that the form of embodiment foreseen in which the dentrifice is in the liquid state, can be replaced by a tube of dentrifice paste.

It is clear that variants and/or modifications can be effected in the accessory for oral hygiene according to the present invention without thereby departing from the scope of the claims appended hereto.

For example, the width of the support element 3 can be constant. Furthermore at the beginning of the groove 11, retention means such as an elastic tongue which can be retracted in the phase of insertion of the part 1*b* into the part 1*a* can be provided.

What I claim is:

1. A pocket accessory for oral hygiene comprising, a case open at one end, a single support element slidable in said case, a pocket tooth-brush and a pocket dentrifice container each projecting from one end of said support, said support element, when said brush and container are introduced into said case, being adapted to constitute a closure element of said open end of said case, and said support element, when said brush and container are in the withdrawn position, being adapted to be inserted into said open end of said case, said case forming a handle of the accessory.

2. Accessory for oral hygiene according to claim 1, wherein the support element of the brush and the container possesses a form slightly constricted towards the extremity opposite to that on which the brush and the container are fixed.

3. A pocket accessory for oral hygiene according to claim 2 wherein the extremity of said support element to which said brush and container are fixed defines a major base, said major base having a cross-section slightly greater than the cross-section of the open end of said case.

4. Pocket accessory for oral hygiene according to claim 1, wherein the width of the support element is constant.

5. Pocket accessory for oral hygiene according claim 1, wherein the case possesses, on two opposite faces, two internal longitudinal ribs extending partly over its length and adapted to constitute a stop for the support element when the latter is applied to the case, with the brush and the container external to the case.

6. Pocket accessory for oral hygiene according claim 1, wherein the tooth-brush is of telescopic type, being made in one part fixed to the support element and at least one part slidable within the said part.

7. A pocket accessory according to claim 1, wherein said case has a projection on a periphery of said open end and said support element has a mating groove for cooperative engagement with said case.

* * * * *